US006949274B2

(12) United States Patent
Nelson et al.

(10) Patent No.: US 6,949,274 B2
(45) Date of Patent: Sep. 27, 2005

(54) PACKAGING SYSTEMS AND METHODS FOR APPLYING SEALANT TO PANELS

(75) Inventors: Thomas J. Nelson, Belton, TX (US); Victoria L. Stolarski, Georgetown, TX (US)

(73) Assignee: Premark RWP Holdings, Inc., Wilmington, DE (US)

( * ) Notice: Subject to any disclaimer, the term of this patent is extended or adjusted under 35 U.S.C. 154(b) by 173 days.

(21) Appl. No.: 10/210,468

(22) Filed: Jul. 31, 2002

(65) Prior Publication Data

US 2004/0020159 A1 Feb. 5, 2004

(51) Int. Cl.[7] ..... B29D 22/00; B29D 23/00; B32B 1/08

(52) U.S. Cl. ..... 428/34.2; 428/35.7; 428/35.6; 428/346; 428/348; 428/349; 428/355 R; 229/5.84; 229/5.85; 206/321; 206/449; 206/813

(58) Field of Search ..... 428/35.7, 34.2, 428/34.3, 36.91, 35.6, 343, 346, 348, 349, 355 R; 229/5.81, 5.84, 5.85; 206/321, 449, 813

(56) References Cited

U.S. PATENT DOCUMENTS 5,099,900 A * 3/1992 Gomberg ..... 152/503
6,158,652 A * 12/2000 Ruiz et al. ..... 229/178

FOREIGN PATENT DOCUMENTS

JP 9-089011 3/1997

* cited by examiner

*Primary Examiner*—Michael C. Miggins
(74) *Attorney, Agent, or Firm*—Welsh & Flaxman LLC

(57) ABSTRACT

Sealant is statically applied to the edges of panels by placing a sealant on the inner surfaces of the walls of a container holding the panels. A shrink wrap sleeve is preferably applied to the panel filled containers, causing contact between the inner surface of the container and panel edges, such that the sealant is transferred to the edges of the panels. Further transfer occurs during handling of the container, due to movement of the panels in the container and contact between the sealant and panel edges.

13 Claims, 3 Drawing Sheets

PACKAGING SYSTEMS AND METHODS FOR APPLYING SEALANT TO PANELS

CROSS-REFERENCE TO RELATED APPLICATIONS

This application relates to U.S. patent application Ser. No. 10/210,469 filed Jul. 31, 2002, entitled "Multipanel Floor System with Sealing Elements," inventors Thomas J. Nelson, et al., which is a continuation-in-part of U.S. patent application Ser. No. 09/662,388, filed Sep. 14, 2000, and U.S. patent application Ser. No. 09/661,705, filed Sep. 14, 2000, both of which are continuations-in-part of U.S. patent application Ser. No. 09/436,317, filed Nov. 8, 1999, all of which are incorporated herein by reference in their entirety.

BACKGROUND OF THE INVENTION

1. Field of the Invention

This invention relates to methods for applying sealant materials to flooring surfaces, and, in particular, to methods for applying sealant to a flooring plank or tile using packaging systems which transfer sealant material from the surrounding packaging material to the flooring plank or tile. When the resulting flooring planks or tiles are assembled, the seal provides a moisture resistant barrier at the seam or junction between adjacent planks or tiles. The invention also provides methods and systems for applying a variety of substances to the contents of a container.

2. Description of the Background

A wide variety of systems have been developed for covering floors and other surfaces. Many systems use a plurality of individual flooring planks or tiles that are placed adjacent to and connected to each other to form a decorative covering for the floor or other surface. In such systems, it is important for the seams or joints between these flooring planks or tiles to be resistant to penetration by water and other fluids.

In order to provide a moisture barrier, sealant materials may be placed on the edges of the flooring planks, or on other components of the flooring system. When placed on the edges of the plank, additional manufacturing steps are required in order to properly apply and position the sealant on the edge. These steps increase production time and require specialized complex equipment, resulting in increased manufacturing costs.

For example, in one in-line manufacturing process used in the production of laminate flooring planks or tiles, various pieces of equipment are connected together via a series of conveyors. During the manufacturing process, the product travels through numerous machining procedures at speeds or feed rates that often exceed 100 linear feet per minute. At these feed rates, it is difficult, if not impossible, to accurately apply a controlled quantity of any form of sealant to all four edge profiles of each flooring plank or tile. Further, any form of sealant placed on the edge profiles of the flooring planks or tiles during the manufacturing process must dry or cure within a short time frame (e.g., one second) to prevent the transfer of wet sealant onto the various processing and/or handling equipment.

Consequently, there is a need for methods and packaging systems which allow the efficient and effective application of sealant to the edges of flooring planks or tiles, while keeping manufacturing costs at a minimum.

SUMMARY OF THE INVENTION

The present invention overcomes the problems and disadvantages associated with current strategies and designs and provides a novel method of statically applying a sealant to the edges of a panel, such as a flooring plank or tile, by applying the sealant to at least a portion of the packaging material containing the panels. The edges of the panels come into contact with the sealant during the packaging process and/or during handling of the package, causing the sealant material to be transferred to the edges of the panel. The invention provides for the static application of sealant to the panel edges using relatively inexpensive but novel packaging materials, and avoids the increased manufacturing costs incurred in known processes in which sealant is directly applied to the edges. The invention is not limited to sealant and panels, but may be broadly used to apply a variety of substances to the contents of a container.

Accordingly, one embodiment of the invention is directed to a method for applying a sealant to at least one edge of a panel comprising: providing a container blank comprising a rectangular base and four walls attached to the base, the base and the walls each having an inner surface and an outer surface; disposing or providing a sealant on the inner surface of at least one of the walls; placing at least one panel adjacent the inner surface of the base, the panel comprising a top surface, a bottom surface and four edges; configuring or folding the container so that the walls are disposed substantially perpendicular to the base, thereby forming a box having at least five sides, and wherein at least a portion of at least one edge of the panel is in contact with or in close proximity to the sealant on the at least one wall; and transferring the sealant to at least the portion of the at least one edge. Preferably, the step of transferring comprises: applying a shrink wrap sleeve around the box; and applying heat to said sleeve, such that the sleeve shrinks and causes contact between the walls and the edges of the panel, thereby transferring the sealant to the portion of at least one edge of the panel.

Another embodiment of the invention is directed to a container for applying sealant to a panel comprising: a base having an inner surface, an outer surface and a plurality of edges; a plurality of walls, each of the walls being attached to one of the plurality of edges of the base, the walls each having an inner surface and an outer surface, the walls adapted to be folded along their respective edges to form a container; and a sealant disposed on the inner surface of at least one of the plurality of walls.

Still another embodiment is directed to a method of applying a substance to the contents of a container comprising: providing a container, the container having a plurality of walls, the walls each having an inner surface and an outer surface; applying the substance to the inner surface of at least one of the walls to form a coated wall; disposing the contents in the container; and transferring the substance to at least a portion of the contents by allowing the coated wall to contact the portion of the contents.

Another embodiment is directed to a container for applying a substance to the contents of the container comprising: at least one wall, the wall having an inner surface and an outer surface; and a substance disposed on the inner surface of the at least one wall. The container may assume any desired shape.

Other embodiments and advantages of the invention are set forth in part in the description which follows, and in part, will be obvious from this description, or may be learned from the practice of the invention.

DESCRIPTION OF THE DRAWINGS

The present invention is better understood by reading the following description of non-limitative embodiments with reference to the attached drawings wherein like parts in each of the several figures are identified by the same reference characters, and which are briefly described as follows.

DESCRIPTION OF THE INVENTION

Figure 1:
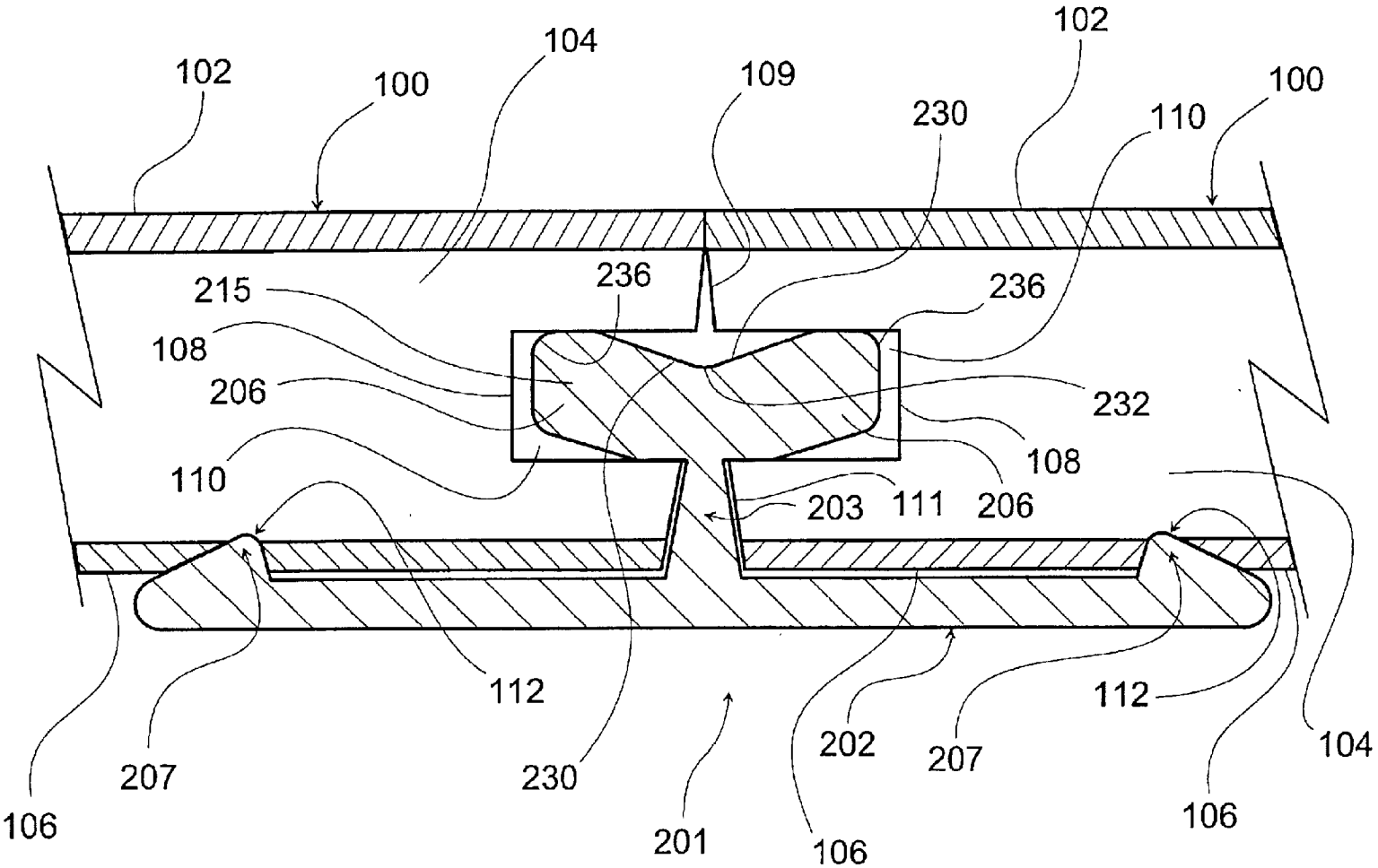
FIG. 1 depicts preferred flooring planks for use in the invention, shown with their preferred connector element.

As embodied and broadly described herein, the present invention is directed to systems for covering floors and other surfaces using a plurality of flooring planks, tiles or other panels or elements. More specifically, the invention relates to methods for applying sealant materials to surfacing components, and, in particular, to methods for applying sealant to a panel, such as a flooring plank or tile, using packaging systems which transfer sealant material from the packaging material to the panel. When the resulting panels are assembled, a moisture resistant seam is provided between adjacent panels. The invention also provides methods and containers for applying a variety of different substances to the contents of a container.

As used herein, the term "panel" broadly includes, but is not limited to, flooring planks, tiles, wall panel systems, ceiling tiles and building/construction components having at least one substantially planar surface, including those that may require or benefit from an edge sealant.

In a preferred embodiment of the invention, the sealant material is applied to the edge of flooring planks used in multipanel floor systems, such as disengageable interconnecting floor systems. In one such preferred embodiment, the planks are part of an overall flooring system which comprises a plurality of flooring planks designed to be joined together with connectors. Each such flooring plank preferably comprises a top wear surface, a substrate, and a bottom surface for contact with a support structure. The plank preferably further comprises at least two edges having identical recesses formed in the edges for receipt of an extension or other projection from the connector. Most preferably, the plank is rectangular or square in shape and comprises four of such edges. Each of the edges has an upper portion disposed adjacent the top wear surface of the flooring plank. The connector preferably comprises a base and an extension extending vertically from the base. The extension is spaced above the base, and, preferably, extends vertically so that it is spaced from and substantially parallel to the base. Preferably, the distance from the base of the connector to the top surface or uppermost point of the extension is less than the distance from the bottom surface to the top wear surface of the planks. The extension is shaped to be received into at least one recess of the plank.

The base of the connecting element may comprise a protrusion or projection, and the flooring plank may have corresponding grooves, recesses or channels in their bottom surfaces shaped to receive the protrusion or projection on the base.

In a preferred embodiment, the flooring plank has both a recess in the edge of the substrate to receive a flange portion of the extension of the connector and a groove in the bottom surface to receive a protrusion in the base of the connector. Preferably, the recesses in the edges and the grooves on the bottom surfaces of the flooring planks extend substantially the entire length of their respective edges and bottom surfaces.

A preferred configuration of one such flooring plank and connector system design is shown in FIG. 1 which depicts the ends of two planks joined by a connector. As shown in FIG. 1, flooring plank 100 comprises a top wear surface 102, a middle substrate 104, a bottom surface 106, a plurality of edges 108, and a recess 110 running longitudinally along at least one edge of the flooring plank. Edges 108 have an upper portion 109 adjacent to the top wear surface 102 and a lower portion 111 adjacent to the bottom surface 106. Upper portion 109 preferably extends horizontally outward farther than lower portion 111. A groove 112 may be provided on the bottom surface. Most preferably, all edges of the flooring plank have identically-shaped recesses and grooves. Recess 110 is shaped or adapted to receive an extension 215 of connector 201. Groove 112 is adapted or shaped to receive projection 207 on the base of the connector.

Connector 201 comprises a base 202 and an extension 215. Extension 215 preferably comprises a vertical support 203 and a mating member comprising two flanges 206, disposed parallel, or substantially parallel to base 202. The extension has a top surface 230 which may have a groove 232 in the center. Each flange 206 has a distal end 236. Base 202 has two projections 207, each of which are shaped to engage with a groove 112 in plank 100.

Although the profile of the flooring plank is preferably shaped as shown in FIG. 1, the planks may assume other shapes without departing from the spirit and scope of the invention. Panels which can be used in the practice of the invention are not limited to the herein described embodiments, but may have any desired configuration, including, but not limited to, the configurations of the flooring planks described in U.S. patent application Ser. No. 10/210,469 filed Jul. 31, 2002 and entitled "Multipanel Floor System with Sealing Elements," which is a continuation in part of U.S. patent application Ser. No. 09/662,388, filed Sep. 14, 2000, and U.S. patent application Ser. No. 09/661,705, filed Sep. 14, 2000, all of which are hereby incorporated herein by reference in their entirety. Further, as will be clear to those of skill in the art, the invention is not limited to such disengageable flooring systems, or even to flooring systems, but may be used in any situation where it is desired to apply a sealant material to an edge of a flooring plank, tile or other panel or element being used to cover a surface.

Figure 2:
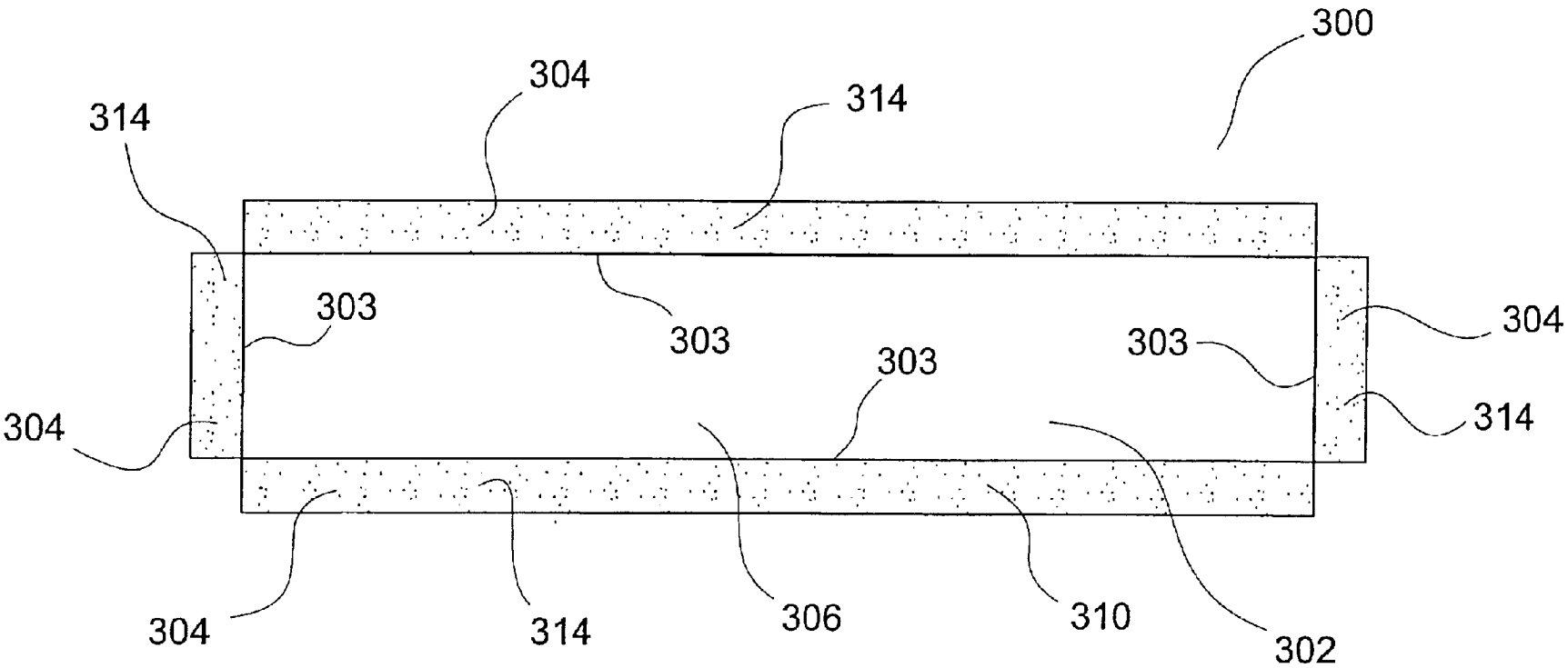
FIG. 2 shows a preferred carton according to one embodiment of the invention, prior to folding.
Figure 3:
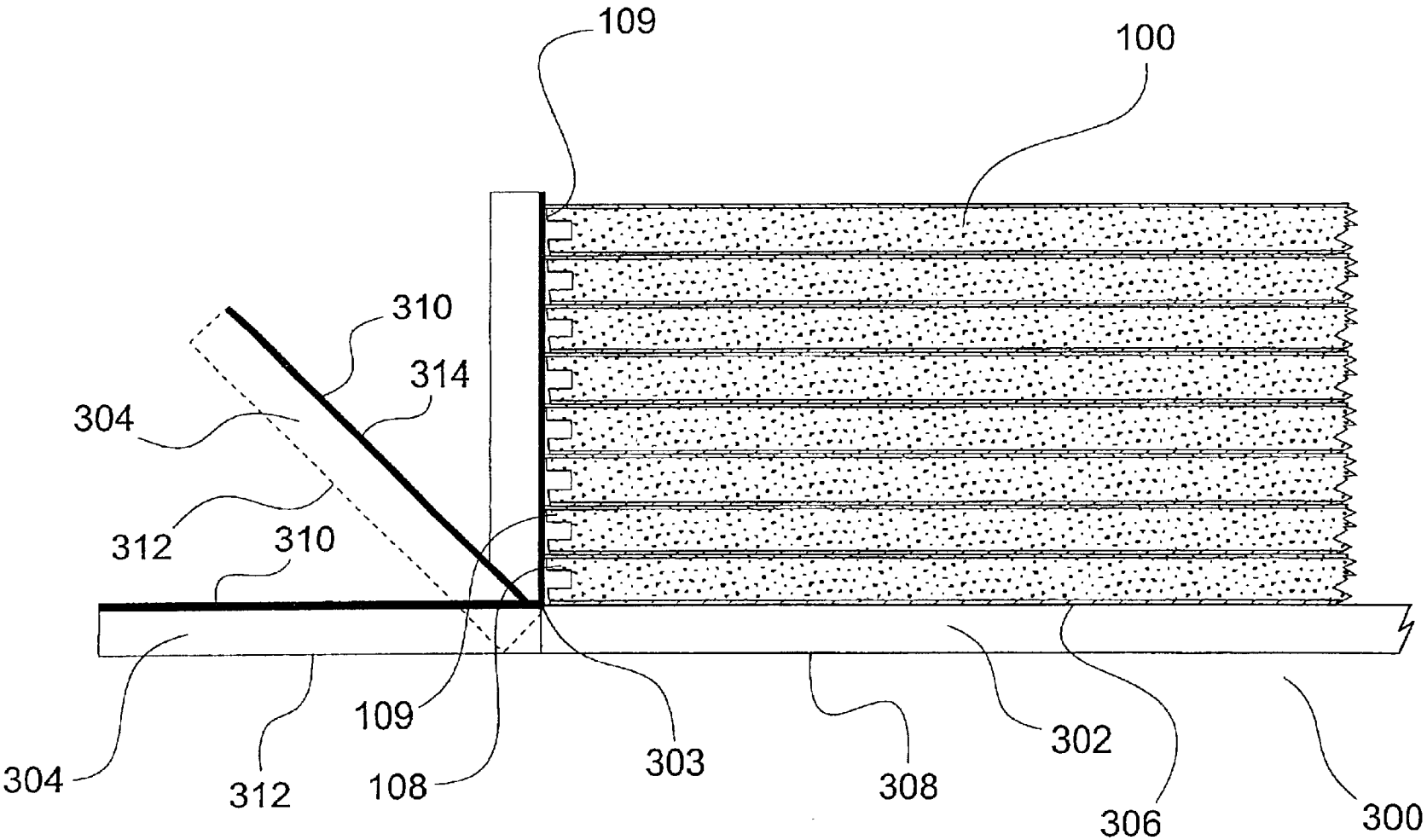
FIG. 3 shows a plurality of planks packaged according to a preferred embodiment of the invention.

According to the invention, sealant is applied to or coated on the appropriate surfaces or flaps located on the sides of a preferably unfolded, flat package, carton or box. A preferred carton according to the invention is shown in FIGS. 2 and 3. FIG. 2 is a perspective view of the inner surface of an unfolded carton or container blank according to a preferred embodiment of the invention. FIG. 3 is a cross-sectional side view showing a plurality of planks in the carton of FIG. 2. Specifically, as shown in FIGS. 2 and 3, carton or container blank 300 preferably comprises a rectangular base 302 and four walls 304 attached to (e.g., integral with and adjacent to) edges 303 of base 302. Base 302 and four walls 304 make up the five sides of container blank 300. The base has an inner surface 306 and an outer surface 308. The walls each have an inner surface 310 and outer surface 312. A sealant 314 is placed on the inner surface 310 of at least one, and preferably all four, of the walls. The base and walls may be made of any desired material, including, but not limited to, paper based products, such as cardboard, and other materials, such as foam or plastic. Most preferably, the carton or container blank is made of cardboard. The sealant may be applied at any time prior to the packaging process, for example, at the box manufacturing company.

Sealant materials that may be applied to the carton or container blank include paraffin and other waxes, silicon, wax based materials, silicon based products, oil based products, adhesives, or any material that can be transferred on contact when heat is applied. Most preferably, the sealant is paraffin wax. The preferred material provides a waterproof or substantially waterproof barrier or seal between the panels/planks and connectors. This material allows for easy disassembly of the flooring elements for repair and other purposes. This preferred material also prevents undue constraint and the resulting stresses that may occur during expansion or shrinking of the installed laminate floor planks. Further, the preferred material will not transfer from box to box in stack under ambient conditions.

The sealant coated, unfolded cartons/container blanks described above are designed to be placed in the magazine of the boxing machine. The boxing equipment preferably removes one unfolded carton from the magazine, inserts or places one or more, and preferably a registered stack of panels (e.g., a registered stack of eight flooring planks or tiles) adjacent the base of the carton, and then folds the four flaps or walls against the four sides of the stack. As shown in FIG. 3, preferably the sealant coated flap surfaces 310 are thereby positioned against, or touching, the edge profiles 108 of the planks or tiles 100. Most preferably, the flaps most closely contact upper portion 109 of edge 108.

Preferably, the loaded carton or container blank is transported to a shrink wrapping station, inserted in a shrink wrap sleeve, and heated to complete the shrink wrap/packaging process. Preferably, the sealant inside the carton or container blank is heat responsive, and exposure to heat during the shrink wrapping process liquifies the sealant, making it transferable to the edges of the plank or tile. The shrink wrapping process forces contact between the sealant coated flaps and the vertical edge surfaces on the edges of the flooring planks or tiles.

The foregoing process applies the sealant via transfer during the boxing/packaging process (after the machining steps) and uses the actual shipping package or carton as the deliver/transfer device to place the sealant in the appropriate location on all four profiled edges of a flooring plank or tile. Uniform transfer is further facilitated by the repeated contact between the coated flap/wall surface and the edges of the flooring planks during the handling, shipping and inventory process.

Accordingly, one embodiment of the invention is directed to a method for applying a sealant to at least one edge of a panel comprising the steps of: providing a container blank comprising a rectangular base and four walls attached to the base, the base and the walls each having an inner surface and an outer surface; disposing or providing a sealant on the inner surface of at least one of the walls; placing at least one panel adjacent the inner surface of the base, the panel comprising a top surface, a bottom surface and four edges; configuring or folding the container so that the walls are disposed perpendicular or substantially perpendicular to the base, thereby forming a box having at least five sides, and wherein at least a portion of at least one of the panel edges is in contact with or in close proximity to the sealant on the at least one wall; and transferring the sealant to at least the portion of the at least one edge of the panel. The at least one panel may be placed in the container before or after the container is folded or configured to form the box.

In a preferred method, the step of transferring comprises: applying a shrink wrap sleeve around the box; and applying heat to said sleeve, wherein the sleeve shrinks and causes contact between the walls and the edges of the panel, thereby transferring the sealant to the portion of the at least one edge. Preferably, the sealant is heat responsive, and the step of applying heat liquifies the sealant, thereby facilitating, enhancing or increasing transfer of the sealant to the panel. Transferring also may occur during handling and shipment as a result of movement of the panel in the box, causing the at least one edge to come into contact with the at least one wall.

Most preferably, the sealant is disposed on the inner surface of all four walls, and the step of transferring comprises transferring the sealant to at least a portion, if not all, of all four edges of the panel. Preferably, the sealant is transferred to the upper portion of the edge, i.e., the portion near the top surface of the panel.

Preferably, the panel is a flooring plank (such as those planks used in disengageable interconnecting flooring systems) or a tile. As will be clear to those of skill in the art, the container blank may be made of any conventional packaging material. Preferably, the container blank is made of a material selected from the group consisting of cardboard or another paper based product, foam or plastic. The preferred sealant is paraffin wax.

The invention is also directed to packages, cartons and other containers for applying sealant to a panel. One such container comprises: a base having an inner surface, an outer surface and a plurality of edges; a plurality of flaps or walls, each of the walls preferably being attached to (e.g., integral with and adjacent to) one of the plurality of edges of the base, the walls each having an inner surface and an outer surface, the walls adapted to be folded along their respective edges to form a container; and a sealant disposed on the inner surface of at least one of the plurality of walls. Preferably, the base is rectangular with four edges, the container has four walls, and the sealant is disposed on all four walls. The base and walls are preferably made of a material selected from the group consisting of cardboard or another paper based product, foam or plastic.

Although the preferred embodiment described herein has four walls and a base, the invention is not limited thereto, and other box and container configurations are possible without departing from the spirit and scope of the invention, so long as a substance on the inner surface of at least one wall makes contact with and transfers the substance to the contents of the container.

For example, another embodiment is directed to a container for applying a substance to the contents of the container comprising: at least one wall, the wall having an inner surface and an outer surface; and a substance disposed on the inner surface of said at least one wall. The container may assume any desired geometric shape, including but not limited to, a box, enclosure or other container having a cross section which has the two-dimensional shape of a triangle, square, rectangle, diamond, pentagon, hexagon, heptagon, octagon, round or oval. The container may be pyramid shaped. The container does not have to be completely enclosed, e.g., it may have one or more openings. The walls of the container do not have to be integral or in one piece. Rather, the container may be made of two or more separate components or parts that can be joined or placed together to form the container. The container may be made of any of the materials described herein. The substance on the at least one wall may be a sealant or any of the various substances described herein.

Although the present invention is particularly well adapted to apply sealant to panels used to cover floors (e.g., a plurality of flooring planks), it is not limited to such applications. Rather, the methods and packaging systems described herein may broadly be used to apply a variety of different substances to any kind of panel or other contents of a package. Accordingly, the invention also includes a method of applying one of a variety of substances to the contents of a container comprising the steps of: providing a container, the container having at least one wall and preferably a plurality of walls, the walls each having an inner surface and an outer surface; applying the substance to the inner surface of at least one of the walls to form a coated wall; disposing, placing or positioning the contents in the container; and transferring the substance to at least a portion of the contents by allowing the coated wall to contact the portion of the contents of the container. Preferably, the substance is heat responsive and transferring further comprises the steps of: applying a shrink wrap sleeve around the container; and applying heat to said sleeve, wherein the sleeve shrinks and causes increased contact between the coated wall and the portion of the contents, thereby transferring the substance to the portion of the contents. The various substances that may be applied as described herein include, but are not limited to, paraffin and other waxes, silicon, wax based materials, silicon based products, oil based products, adhesives or any material that can be transferred on contact when heat is applied. However, the invention is not limited to the foregoing, and may be used to transfer, for example, ink, catalysts, dyes and other substances.

Other embodiments and uses of the invention will be apparent to those skilled in the art from consideration of the specification and practice of the invention disclosed herein. Although the invention has been described with respect to preferred embodiments, the foregoing description and examples are intended to be merely exemplary of the invention. Not all embodiments of the invention will include all the specified advantages. The true scope and spirit of the invention is not intended to be limited by the foregoing description and examples, but instead is intended to be commensurate with the scope of the following claims. Variations and modifications on the elements of the claimed invention will be apparent to persons skilled in the art from a consideration of this specification or practice of the invention disclosed herein.

We claim:

1. A container for applying sealant to a panel comprising:

a base having an inner surface, an outer surface and a plurality of edges;

a plurality of walls, each of said walls being attached to one of said plurality of edges of said base, said walls each having an inner surface and an outer surface, said walls adapted to be folded along their respective edges to form a container; and a sealant disposed on said inner surface of at least one of said plurality of walls, said sealant transferring from said inner surface of said at least one of said plurality of walls to a panel upon activation thereof, wherein said sealant substantially covers said inner surface of said at least one of said plurality of walls providing for substantial transfer of said sealant from said inner surface of said at least one of said plurality of walls to a panel positioned within said container.

2. The container of claim 1 wherein said base and walls are made of a material selected from the group consisting of cardboard, foam and plastic.

3. The container of claim 1 wherein said sealant is selected from the group consisting of paraffin, wax, silicon, a wax based material, a silicon based product, an oil based product and an adhesive.

4. The container of claim 1 wherein said base and walls are made of a material selected from the group consisting of cardboard, foam and plastic.

5. The container of claim 1 wherein said sealant is selected from the group consisting of paraffin, wax, silicon, a wax based material, a silicon based product, an oil based product and an adhesive.

6. The container of claim 1 wherein said base is rectangular and has four edges.

7. The container of claim 6 wherein said container comprises four walls.

8. The container of claim 7 wherein said sealant is disposed on all four walls.

9. The container of claim 1 further including at least one panel housed within said container, said at least one panel being in contact with said sealant.

10. The container of claim 9 wherein an edge of said at least one panel is in contact with said sealant.

11. The container of claim 1 wherein the sealant is heat activated.

12. The container of claim 11 further including shrink wrap about the container bringing said at least one of said plurality of walls into contact with said panel for the transfer of sealant from said inner surface of said at least one of said plurality of walls to said panel upon activation of the sealant.

13. A container for applying sealant to a panel comprising:

a base having an inner surface, an outer surface and a plurality of edges;

a plurality of walls, each of said walls being attached to one of said plurality of edges of said base, said walls each having an inner surface and an outer surface, said walls adapted to be folded along their respective edges to form a container;

at least one panel housed within said container; and a sealant disposed on said inner surface of at least one of said plurality of walls, said sealant transferring from said inner surface of said at least one of said plurality of walls to said panel upon activation thereof, wherein said sealant substantially covers said inner surface of said at least one of said plurality of walls providing for substantial transfer of said sealant from said inner surface of said at least one of said plurality of walls to said panel positioned within said container.

* * * * *